US005820095A

United States Patent [19]

Stone

[11] Patent Number: 5,820,095

[45] Date of Patent: Oct. 13, 1998

[54] HOLDER DEVICE FOR WRITING IMPLEMENTS

[76] Inventor: John W. Stone, 4989 Buffalo Creek Dr., Evergreen, Colo. 80439

[21] Appl. No.: 63,919

[22] Filed: May 18, 1993

Related U.S. Application Data

[63] Continuation-in-part of Ser. No. 978,130, Nov. 18, 1992, and a continuation-in-part of Ser. No. 1,639, Nov. 18, 1992.

[51] Int. Cl.[6] ..... A47F 7/00; G09F 7/18

[52] U.S. Cl. ..... 248/316.7; 211/69.1; 248/205.3; D19/77; D19/83; D19/84; D19/99; 281/30

[58] Field of Search ..... 248/229, 231.8, 248/74.2, 316.7, 205.3, 229.1, 231.81; 281/30; 211/69.1–69.9, 69; D19/65, 75, 77, 78, 81–85, 99, 100

[56] References Cited

U.S. PATENT DOCUMENTS

| | | | |
|---|---|---|---|
| 2,128,005 | 8/1938 | Lombard | 248/74.2 X |
| 2,161,855 | 6/1939 | Copell | 248/316.7 |
| 2,609,578 | 9/1952 | Andary | 248/229 X |
| 2,641,809 | 6/1953 | Kimball | 248/229 X |
| 3,056,412 | 10/1962 | Wolfe | 248/229 |
| 3,154,281 | 10/1964 | Frank | 248/74.2 X |
| 3,228,640 | 1/1966 | Walsh | 248/229 X |
| 4,580,360 | 4/1986 | Gribb . | |
| 4,609,171 | 9/1986 | Matsui | 248/74.2 X |
| 4,614,321 | 9/1986 | Andre | 248/74.2 |
| 5,160,105 | 11/1992 | Miller | 248/231.8 X |
| 5,178,354 | 1/1993 | Engvall | 248/316.7 |

FOREIGN PATENT DOCUMENTS

| | | | |
|---|---|---|---|
| 461277 | 2/1937 | United Kingdom | 248/229 |

*Primary Examiner*—Frances Han
*Attorney, Agent, or Firm*—Timothy J. Martin

[57] ABSTRACT

The present invention relates to a holder device that is mountable on a support and adapted to removeably secure elongated writing implements thereto. The holder device includes a base portion adapted to mount on the support and a pair of wing portions extending away from the base portion and converging toward on another to terminate in a free wing edge so that the wing portions and the base portion define a longitudinally extending channel sized to receive an elongated writing implement. The channel has a longitudinal mouth located between the wing edges whereby the writing implement may be inserted through the mouth into the channel. In the preferred embodiment of the present invention the channel has grooves therein to permit a variety of sizes of writing implements to be mounted. The invention includes alternative mounting structure, one embodiment has an adhesive layer on the base portion; another embodiment includes a clip structure for removeably mounting the device.

16 Claims, 3 Drawing Sheets

HOLDER DEVICE FOR WRITING IMPLEMENTS

This application is a continuation-in-part application of my previously filed applications Ser. No. 07/978,130 filed Nov. 18, 1992 entitled ORGANIZATIONAL DEVICE and Design Ser. No. 29/001,639 filed Nov. 18, 1992 entitled SELF-STICKING PEN/PENCIL CLIP.

FIELD OF THE INVENTION

The present invention relates to an organizational product for the home and office. More particularly the present invention relates to an organizational device for writing instruments. Specifically, the present invention is a mountable holder device adapted to removeably secure writing implements on any of a variety of items.

BACKGROUND

The form of the writing implement has progressively changed over the centuries. The evolution of the writing implement follows a path from the papyrus reed, the quill, chalk, pencil to pen. As the writing implement of choice has changed, so has the need to have ready access to the writing implement increased as society has modernized. The necessity of having a writing desk with quill and ink bottle to dash off a note has been eliminated with the invention of the pen and pencil. The writing instrument is now as accessible and mobile as the user.

In today's hectic offices and homes the need for a writing implement at a variety of places has developed into an organizational nightmare. Sometimes, a collection of pens or pencils are stored by each phone, copy machine, computer, etc., or are stored in a desk drawer, near the equipment or are simply carried in a user's pocket or purse. Often to assure that a pen or pencil is available it is secured at the desired location by a cord, or chain. This, of course, is quite awkward. Where a multiple number of pens and pencils are haphazardly stashed at each location, organization is less than efficient. Further, tying the implement at the desired location often results in undesirable ink or pencil marks.

Not only are these methods of providing access to writing implements inefficient, they are quickly becoming archaic in today's world. Once there was a time when a pencil could be tied by the phone or to the phone cord, and though awkward, it was accessible when needed. Today, the phone often is portable and does not have a set location or even a cord. Likewise, lap top computers and portable copy machines no longer have set locations at which to stash writing implements. Furthermore, if a pen or pencil is tied to the machine, the user is limited by the length of this string and by the implement that was selected.

Alternatively, pen or pencil mounting devices have been employed. For example, some clip boards have a pen holder, likewise bulletin boards may have complimentary hook and loop fastener on the writing implement and the board. Even the use of holder devices presently known in the art does not resolve the organizational issues of either the office or the home. Often different writing implements are useful at different times. For example, a highlighter may be useful in reviewing a document, a correction pen may be employed in revision of a document, and a pencil may be the preferred implement when drafting a document. The prior art holders are sized to fit a specific writing instrument and do not readily accommodate larger diameter writing instruments such as highlighters or felt pens. Furthermore, the use of hook and loop fasteners restricts the user to a specific implement that is matched to the complimentary mounting means attached to the support. These organizational devices do not provide a holder which can be mounted on almost any surface and will hold a variety of types and sizes of instruments securely so that the instrument is not readily dislodged causing undesirable pen or pencil marks. The following invention has evolved to satisfy these needs.

SUMMARY OF INVENTION

An object of the present invention is to provide a removeably mountable holder device operable to permit mounting of a writing implement on almost any surface.

Still a further object of this invention is to provide one holder device, which can retain writing implements of various diameters.

Another object of the present invention is to provide an inexpensive, disposable device for holding writing implements.

Yet another object of the present invention is to provide a holder device which is simple to use and will avoid accidental dislodgement of the writing implement.

In its broadest form, the holder device of the present invention is employed to removeably mount writing implements on a support surface. Generally this holder device is a single unit including a base portion having opposite lateral edges adapted to mount to a surface of a selected support. A pair of resident wing portions are each joined to the base portion at a junction along a respective lateral edge of the base portion. The wing portions extend away from the base portion and converge toward one another, the wing portions terminate in a free wing edges. The wing portions and the base portion define a longitudinally extending channel sized to receive an elongated writing implement such as a pen or pencil. The channel, which retains the pen or pencil has opposite open ends through which the pen or pencil extends. The channel also has a longitudinal mouth located between the wing edges whereby the writing implement may be inserted through the mouth and retained within the channel.

More specifically, the present invention has a bottom surface located on a side thereof opposite the wing portions. This surface includes an adhesive layer operative to adhere to the support surface. Alternatively, instead of an adhesive layer, a clip structure can be disposed on the bottom surface. The clip structure includes a first jaw element operative to engage the support when the holder device is mounted thereon. The clip structure, the base portion and the wing portions are preferably formed in as a unitary, integral one piece construction of stiff yet resilient material. Where a clip structure is employed, the device may be slid onto a support. This clip structure preferably includes a second jaw element defined by the bottom surface of the base portion. The second jaw element and the first jaw element thus define a longitudinal clip channel adapted to mateably receive the support.

The preferred embodiment of the present invention includes a longitudinal groove formed proximate to each respective junction location in the cylindrically shaped channel. These grooves are operative to permit deflection of the wing portions away from one another and thereby to reduce bending moments of force on the base portion when the writing implement is inserted through said mouth. Preferably, the grooves are semi-circular in cross-section; however, the grooves can be triangular in cross-section. In some embodiments of the invention each of the wing portions uniformly taper from the base portion to its free wing edge, and in other embodiments the wing portions terminate in an enlarged longitudinally extending lobe.

These and other objects of the present invention will become more readily appreciated and understood from a consideration of the following detailed description of the preferred embodiment when taken together with the accompanying drawings, in which:

DETAILED DESCRIPTION OF THE PREFERRED EMBODIMENT

The present invention is directed to a holder device for securely retaining a writing implement, such as a pen, pencil, marker and the like, to a support surface, such as at a location nearby to a telephone, copy machine, notebook, etc. Several embodiments are described herein, but broadly each embodiment is formed as an integrally molded piece of stiff yet resilient plastic, and each embodiment includes a base portion, and a pair of opposed wings that define a channel operative to receive the writing instrument therein.

Figure 1:
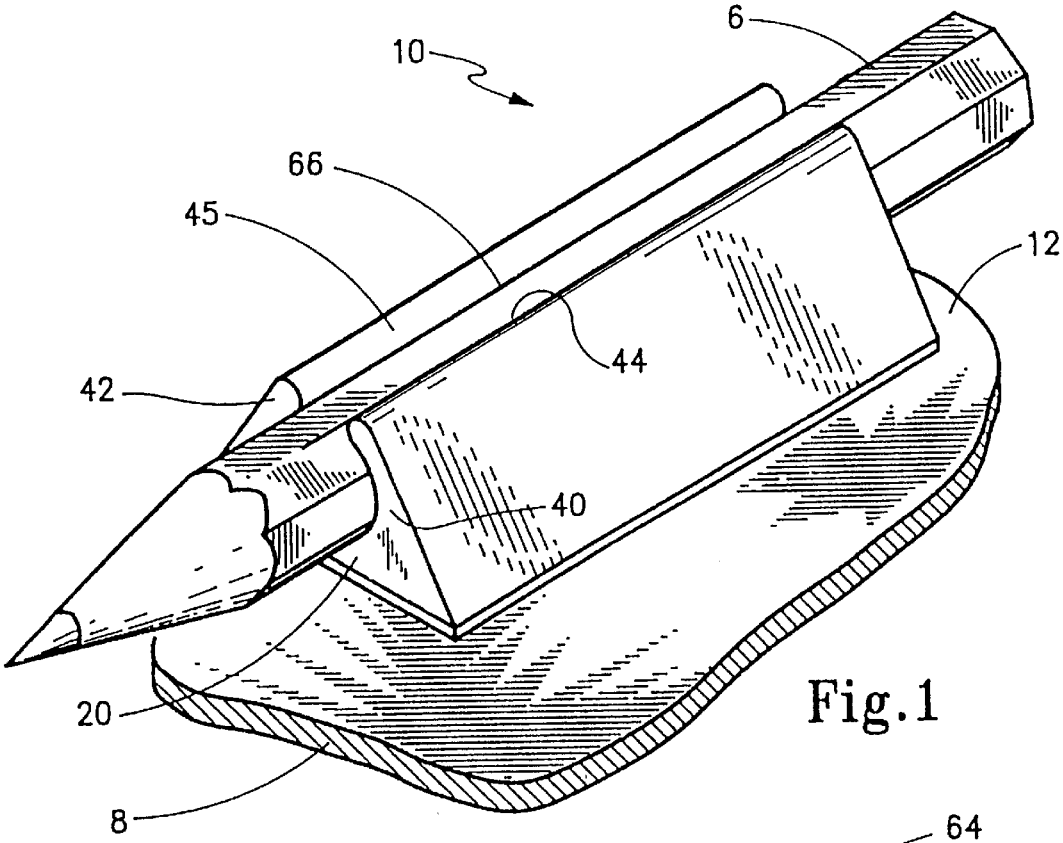
FIG. 1 is a perspective view of a first exemplary embodiment of a holder device of the present invention shown mounted on a surface with a writing implement retained therein.
Figure 2:
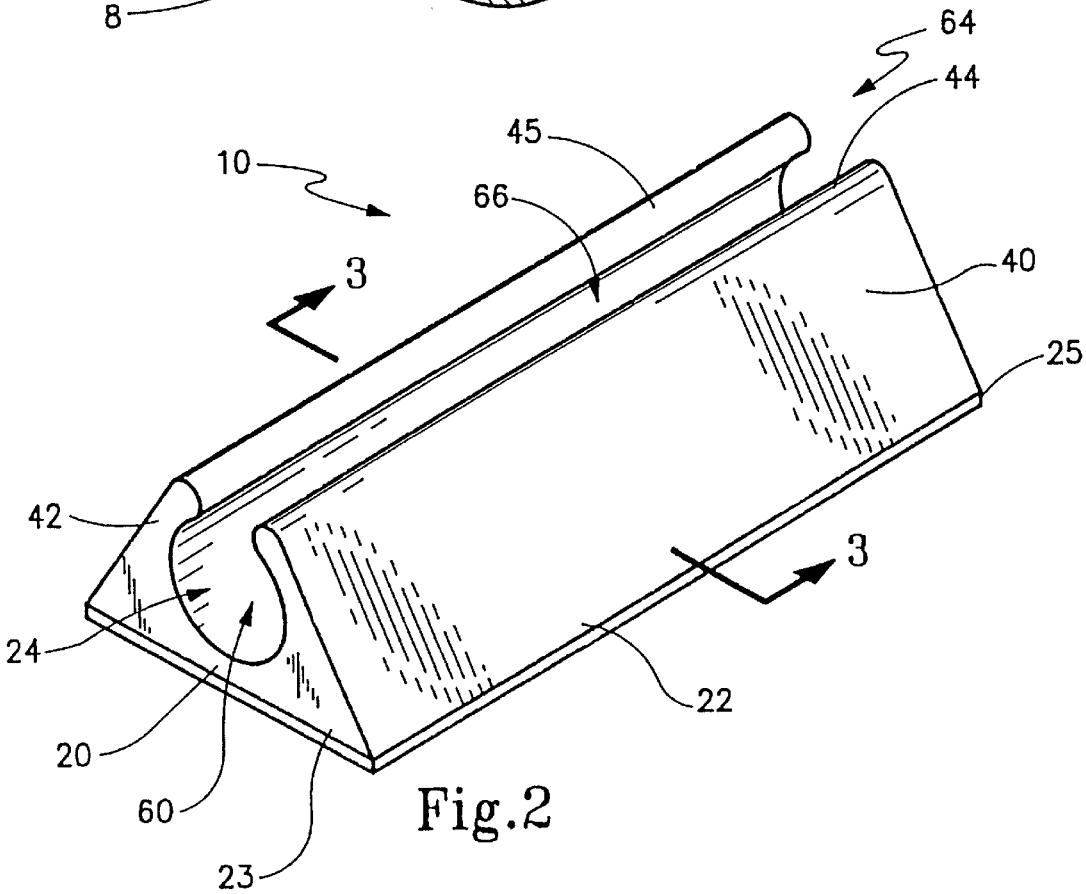
FIG. 2 is a perspective view of holder device shown in FIG. 1 with the writing implement removed.
Figure 3:
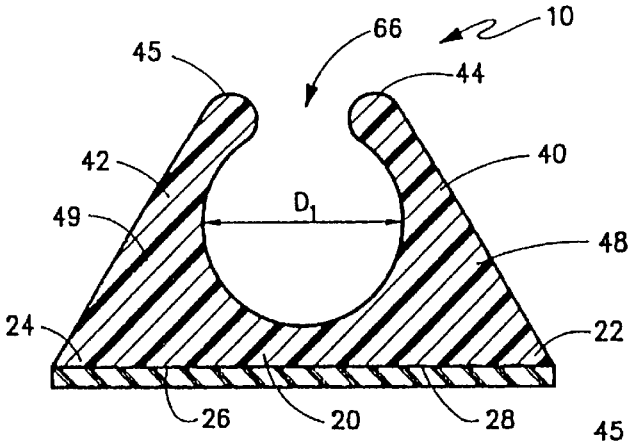
FIG. 3 is a cross sectional view taken about lines 3—3 of FIG. 2.

A first embodiment of the invention is shown in FIGS. 1–4. In FIG. 1, the holder device 10 is mounted on a support 8 and is shown securely retaining an elongated writing implement 6 which, in this instance is a pencil, on the support. The holder device 10 has a base portion 20, that is adapted to be mounted on a support 8. As best shown in FIG. 2 and 3, the base portion 20 has an outer perimeter that extends around the base portion 20, and base portion 20 includes lateral edges 22, 24, which extend longitudinally at the sides thereof and a front edge 23 and a rear edge 25 that each extend transversely to the lateral edges 22, 24. The base portion 20 also has a bottom surface 26 that is operative to be secured to the support surface 12. A pair of wing portions 40, 42 extend away from base portion 20 in a common direction so that a cylindrically shaped channel 60 that extends from one open end 62 to the opposite open end 64.

As is best shown in FIG. 3, the bottom surface 26 is preferably provided with an adhesive layer 28. The adhesive layer 28 selected will vary depending on the material make up of the support 8. The support can be made of hard plastics; (for example, phones, computers, some clipboards) paper, wood, (for example desks, some clipboards), note pads, cork, (for example bulletin boards) masonite, slate, marker boards to name a few. The adhesive layer 28 can be double sided tape, a hook and loop fastening strip, a glue product or other suitable mounting element known to those with ordinary skill in the art as long as it is selected to adhere to the composition material of the support. By varying the adhesive layer the present invention can be readily mounted on any of a variety support surfaces, thus making the writing instrument readily accessible to today's mobile user.

Figure 4:
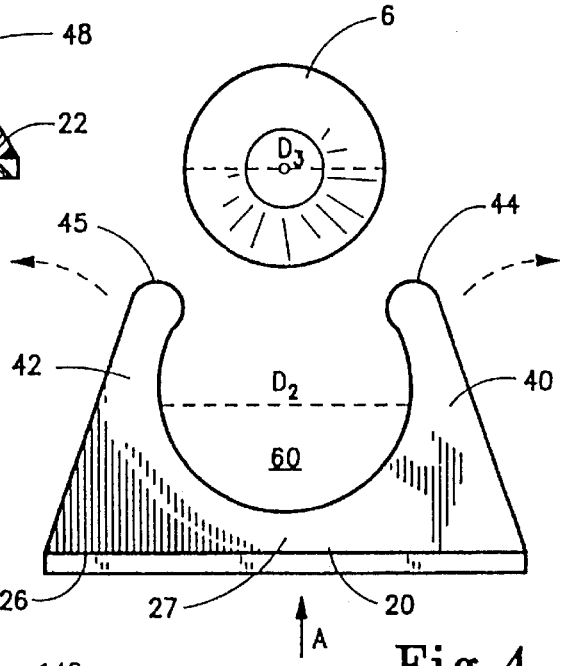
FIG. 4 is an end view in elevation of the holder device shown in FIGS. 1–3 with the wing portions thereof deflected for insertion of a writing implement.

Wing portions 40 and 42 are best shown in FIGS. 2 and 3, Here, wing portions 40, 42 are attached to the base portion 20 at junction locations 48, 49 respectively. The wing portions 40, 42 and the base portion 20 are formed as a unitary, integral one piece construction of stiff, yet resilient material. This permits the wing portions 40 and 42, which converge toward one another, to perform two important functions, namely receiving and retaining the writing implement 6. As is shown in FIGS. 1 and 4, the wing portions 40, 42 have two positions. One position of the wing portions 40, 42, is the engaging position wherein the wing portions 40, 42 converge toward one another. A second position of the wing portions 40, 42 is the receiving position best shown in FIG. 4.

The wing portions 40, 42 terminate in free wing edges 44, 45. The wing portions 40, 42 and the base portion 20 then define the longitudinally extending channel 60 which accordingly has open ends 62 and 64 and a longitudinal mouth 66 located between wing edges 44 and 45. In the receiving position 38, the mouth 66 can be widened by spreading the free wing edges 44, 45 away from one another. Placing the wing portions 40, 42 in the receiving position effectively expands the diameter "$D_1$," shown in FIG. 3 to "$D_2$" as shown in FIG. 4. If the diameter of the writing implement 6, noted here as "$D_3$", is substantially larger than "$D_1$", however, then the bending moment of force, shown in FIG. 4 by arrow A, may cause the mid section 27 of the base portion 20 to arch away from the support. The base portion's 20 tendency to arch when the diameter of the writing instrument is larger then the diameter of the channel 60 when in the engaging position may result in dislodgement of the mounting means from the support surface. Thus, this embodiment is best used with writing implements that are no more than slightly larger than $D_2$.

Figure 5:
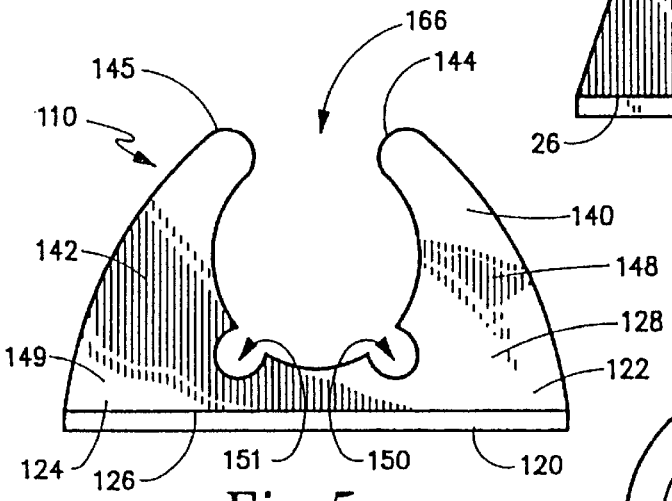
FIG. 5 is an end view in elevation of a second exemplary embodiment of the present invention.
Figure 6:
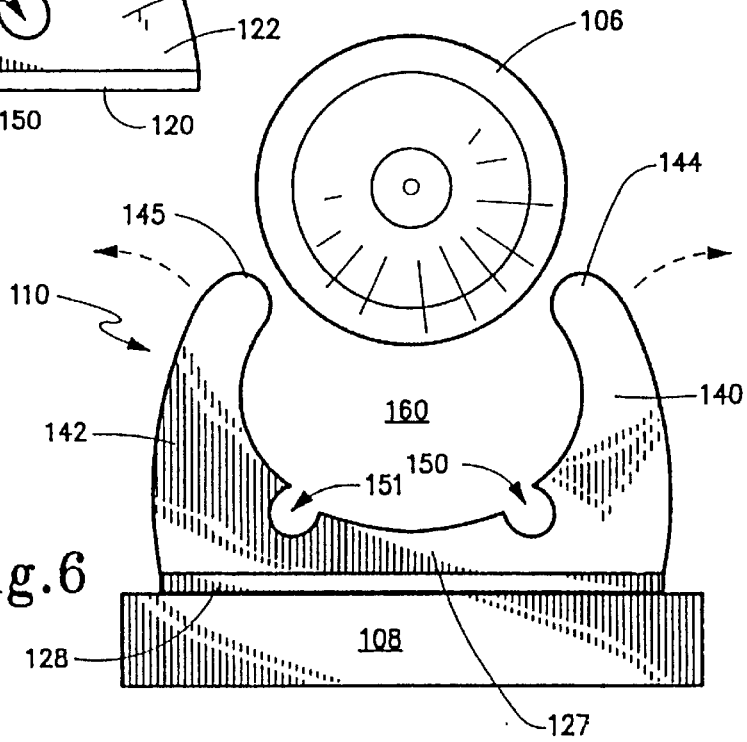
FIG. 6 is an end view in elevation of the embodiment of the present invention shown in FIG. 5 but with the wings deflected to receive the writing implement.

To counter the adverse effects of a possible bending moment and to permit use of the holder device with variously sized writing implements, a more preferred embodiment of the present invention has been developed, and this preferred embodiment is shown in FIG. 5. The preferred embodiment, like FIGS. 1–4, is in the form of a holder device 110 that includes a base portion 120, mounting means 128 on the bottom surface 126, wing portions 140, 142 that terminate in free wing edges 144, 145 that are moveable between the engaging and receiving positions, a mouth 166, and a channel 160. Holder device 110 of the preferred embodiment also includes longitudinal grooves 150, 151, which are formed proximate the junction locations 148, 149 respectively, in the channel 160. These grooves extend in a substantially parallel direction adjacent the lateral edges 122, 124 of the base portion 120. As shown in FIGS. 5 and 6, grooves 150 and 151, function to permit both large and small diameter writing instruments 106 to be securely retained within the channel 160 without substantial dislodgement of the holder device 110 from the support 108 it is mounted on. The grooves 150, 151 are operative to permit deflection of the wing portions 140, 142 away from one another while reducing the bending moments of force on the mid portion 127 of the base portion when the writing implement 106 is being inserted through the mouth 166 when the writing implement or is being retained within the channel 160. The grooves 150, 151 in the preferred embodiment are semi-circular in cross-section.

Figure 7:
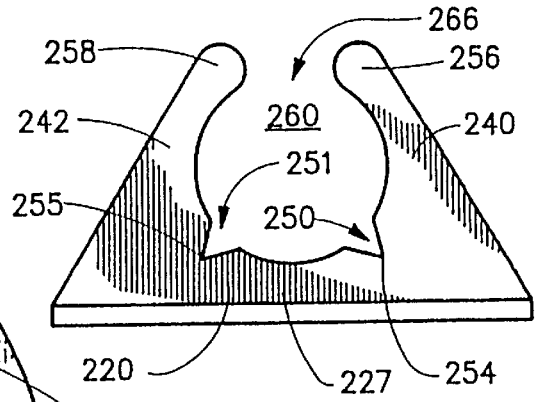
FIG. 7 is an end view in elevation of an alternative embodiment of the present invention.

As shown in FIG. 7, an alternative embodiment of the present invention can include longitudinal grooves 250, 251 having a different cross-section then shown in FIG. 6. Similarly, FIG. 7 shows different wing portions 240, 242 then the wing portions 140, 142 shown in FIGS. 5 and 6. In FIG. 5, the wing portions 140, 142 uniformly taper from said base portion 120 to its free wing edges 144, 146 respectively. The wing portions shown in FIG. 7, on the other hand, do not show the uniform tapering of the wing portions. The configuration of the wing portions 240, 242 more readily illustrate that the wing portions terminate in an enlarged longitudinal lobes 256, 258. The curvature of these lobes 256, 258 facilitate deflection of wing portions 240 and 242 away from one another when a writing implement is introduced into mouth 266 of channel 260.

Further, as is shown in FIG. 7, grooves 250 and 251 are triangular in cross-section. This configuration, like the grooves shown in FIGS. 5 and 6, reduce the moment of force that is exerted on the mid portion 227 of the base portion 220 when the wings 240, 242 are placed in the receiving position. However, the repeated movement between the receiving and engaging positions may stress the resilient material at the vertices 254, 255 of grooves 250, 251 resulting in fatigue of the material. Thus, the semi-circular grooves 250, 251 are the preferred structure.

Figure 9:
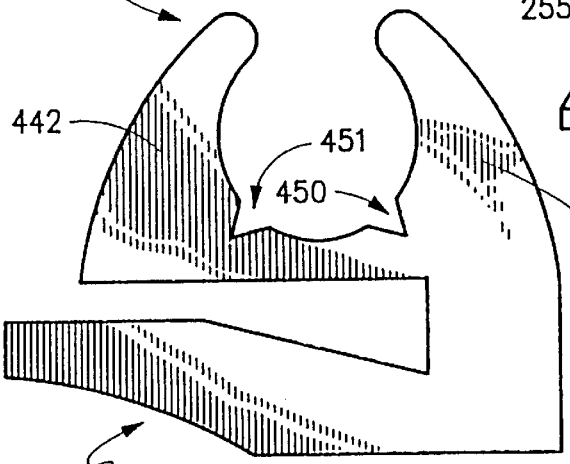
FIG. 9 is an end view of elevation of a fourth exemplary embodiment of the present invention including the triangular grooves and the clip structure.
Figure 8:
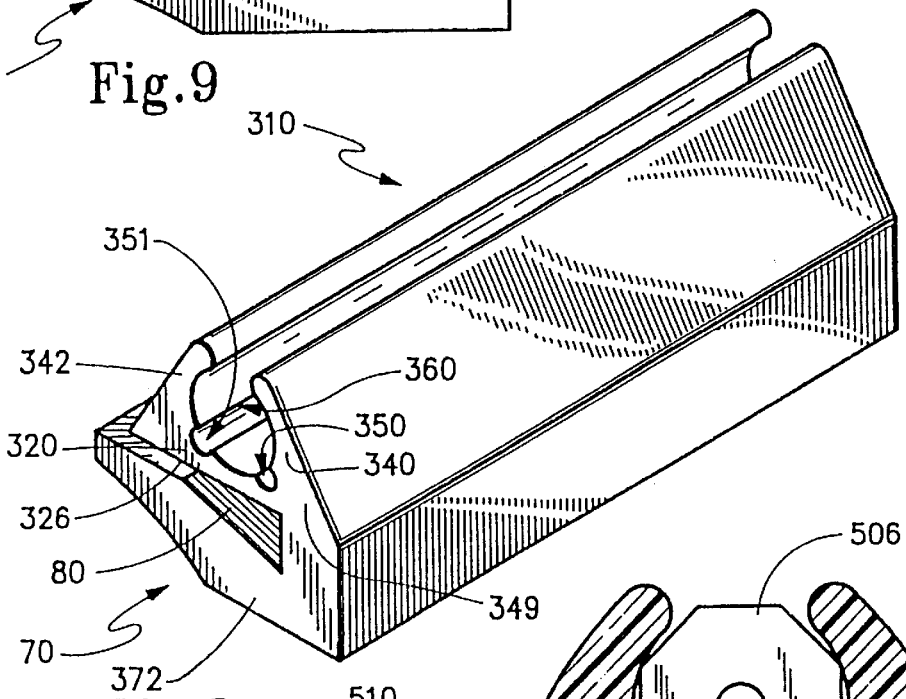
FIG. 8 is a perspective view of a third exemplary embodiment of the present invention that includes a clip structure for mounting onto a support.
Figure 10:
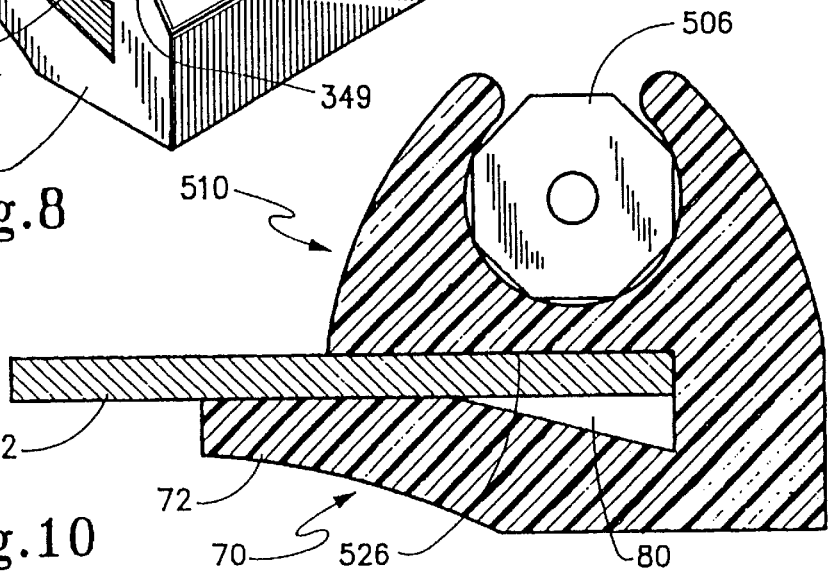
FIG. 10, is an end view in cross-section of a fifth exemplary embodiment of the present invention mounted on a surface and retaining a writing implement therein.

Additional exemplary embodiments of the present invention are shown in FIGS. 8, 9 and 10. In each of these figures, a clip structure 70 is added to the holder device as part of the unitary one-piece construction. For example, in FIG. 8, clip structure 70 is shown as part of holder device 310 and is attached along a junction location 349 opposite to wing portion 340. Clip portion 70 includes a jaw element 372 which is in an opposed relation to bottom surface 326 of base portion 320 such that base portion 320 forms a second jaw element which, together with jaw element 372 forms a longitudinal clip channel 80 that extends longitudinally of holder device 310. Wing portion 342 is in an opposed relationship with wing portion 341 so that, together with base portion 320, wing portions 340 and 342 define a longitudinal channel 360 adapted to receive a writing implement. Semi-circular grooves 350 and 351 are again provided as discussed with respect to the embodiment shown in FIGS. 5 and 6.

Holder device 410, shown in FIG. 9, is substantially identical to holder device 310 with the exception that, in this embodiment, wing portions 440 and 442 are formed substantially the same as wing portions 140 and 142 shown in FIGS. 5 and 6 and with the further modification that grooves 450 and 451 are triangularly shaped grooves similar to grooves 252 and 253 shown in FIG. 7.

FIG. 10 shows a writing implement 506 and the clip structure 70 of a holder device 510 in cross-section. As is readily shown in FIG. 10, the longitudinal clip channel 80 is adapted to slidingly receive and engage in the mounted state the support 12. The first jaw element 72 is configured to press upwardly toward said bottom surface 526 so that when the support surface 12 is mounted therein it is mateably engaged by the clip channel 80.

Accordingly, the present invention has been described with some degree of particularity directed to the preferred embodiment of the present invention. It should be appreciated, though, that the present invention is defined by the following claims construed in light of the prior art so that modifications or changes may be made to the preferred embodiment of the present invention without departing from the inventive concepts contained herein.

I claim:

1. A holder device mountable on a support surface of a support and adapted to removably secure elongated writing implements thereto, the holder device comprising:

a base portion having opposite lateral edges and adapted to mount on said support surface; and a pair of resilient wing portions each joined to said base portion longitudinally along a junction location, said wing portions extending away from said base portion and converging toward one another to terminate in a free wing edge so that said wing portions and said base portion define a longitudinally extending channel sized to receive an elongated writing implement, said channel having opposite open ends and a longitudinal mouth located between said wing edges whereby said writing implement may be inserted through said mouth and retained within said channel, and including a longitudinal groove formed proximate to each respective junction location in said channel adjacent to a respective lateral edge of said base portion, said grooves operative to permit deflection of said wing portions away from one another thereby to reduce bending moments of force on said base portion when said writing implement is inserted through said mouth.

2. A holder device according to claim 1 wherein said base portion has a bottom surface located on a side thereof opposite said wing portions, and including an adhesive layer on said bottom surface operative to adhere to the support surface.

3. A holder device according to claim 1 including a clip structure disposed on said bottom surface, said clip structure including a first jaw element operative to engage said support when said holder device is mounted on said support surface.

4. A holder device according to claim 3 wherein said clip structure, said base portion and said wing portions are formed in as a unitary, integral one piece construction of stiff yet resilient material.

5. A holder device according to claim 3 wherein said clip structure includes a second jaw element defined by said bottom surface of said base portion, said second jaw element and said first jaw element defining a longitudinal clip channel adapted to mateably receive said support therein.

6. A holder device according to claim 1 wherein said grooves are semi-circular in cross-section.

7. A holder device according to claim 1 wherein said grooves are as triangular in cross-section.

8. A holder device according to claim 1 wherein said longitudinal channel is cylindrically shaped.

9. A holder device according to claim 1 wherein each of said wing portions uniformly taper from said base portion to its free wing edge.

10. A holder device according to claim 1 wherein said wing portions terminate in an enlarged longitudinally extending lobe.

11. A holder device mountable on a support surface of a support and adapted to removably secure elongated writing implements thereto, the holder device comprising:

a base portion having opposite lateral edges and adapted to be mounted on said support surface;

a pair of resilient wing portions each joined to said base portion at a junction location and formed as an integral one-piece construction therewith, said wing portions extending away from said base portion and converging toward one another, each said wing portion terminating in a free wing edge so that said wing portions and said base portion define a longitudinally extending channel therebetween with said channel having opposite open ends and a longitudinal mouth located between said wing edges whereby said writing implement may be inserted through said mount and retained within said channel; and a first resilient jaw element disposed on said base portion oppositely of said wing portions and operative to engage said support when said holder device is mounted on said support surface, said base portion defining a second jaw element such that said first law element and said base portion define a longitudinal clip channel adapted to receive said support therein.

12. A holder device according to claim 11 including a pair of longitudinal grooves, each said groove located proximate the juncture location in said channel, said grooves operative to permit the deflection of said wing portions away from one another to reduce bending moments of force on said base portion when said writing implement is inserted through said mouth.

13. A holder device according to claim 12 wherein said grooves are semi-circular in cross-section.

14. A holder device according to claim 12 wherein said grooves are triangular in cross-section.

15. A holder device according to claim 11 wherein said holder device is formed as an integral one piece construction of stiff, yet resilient materials.

16. A holder device mountable on a support surface of a support and adapted to removably secure elongated writing implements thereto, the holder device comprising:

an elongated base portion having a width measured between opposite lateral edges and a length measured longitudinally thereof said length being greater than said width, said base portion adapted to mount on said support surface; and an elongated pair of wing portions formed integrally and coextensively with said base portion as a one-piece construction of stiff yet resilient material and joined to the base portion along a respective longitudinally extending junction location, said wing portions each extending away from said base portion and converging toward one another to terminate in a free wing edge so that said wing portions and said base portion define a longitudinally extending channel sized to receive an elongated writing implement, said channel having opposite open ends and a longitudinal mouth located between said wing edges whereby said writing implement may be inserted through said mouth and retained within said channel, each said wing portion tapering in a cross-section with said free wing edge formed as an enlarged longitudinally extending lobe, and including a longitudinal groove formed proximate to each respective junction location in said channel adjacent to a respective lateral edge of said base portion.

* * * * *